US006821191B2

(12) United States Patent
Lim et al.

(10) Patent No.: US 6,821,191 B2
(45) Date of Patent: Nov. 23, 2004

(54) BALL FINISHING PROCESS

(75) Inventors: Dong Keun Lim, Seoul (KR); Eui Mun Lee, Ansan-si (KR); Jung Gyu Moon, Siheung-si (KR)

(73) Assignee: Fantom Company, Ltd., Seoul (KR)

( * ) Notice: Subject to any disclaimer, the term of this patent is extended or adjusted under 35 U.S.C. 154(b) by 0 days.

(21) Appl. No.: 10/279,321

(22) Filed: Oct. 24, 2002

(65) Prior Publication Data

US 2004/0082280 A1 Apr. 29, 2004

(51) Int. Cl.[7] ..... B24B 11/02

(52) U.S. Cl. ..... 451/50; 241/171; 241/175; 51/163.2; 451/32; 451/104; 451/113

(58) Field of Search ..... 451/32, 104, 113, 451/326–328, 50; 241/171, 172, 176, 182; 51/163.2, 163.1

(56) References Cited

U.S. PATENT DOCUMENTS 1,945,978 A 2/1934 Palombo et al.
2,700,254 A * 1/1955 Kinker et al. ..... 451/104
2,812,376 A * 11/1957 Yardney ..... 429/66
3,603,036 A 9/1971 Reed
3,717,957 A * 2/1973 Walker ..... 451/85
3,744,710 A * 7/1973 McCartney ..... 210/363
3,924,357 A * 12/1975 Schmidt et al. ..... 451/86
4,216,629 A * 8/1980 DeGaeta ..... 451/50
4,307,544 A * 12/1981 Balz ..... 451/32
4,958,776 A * 9/1990 Walther ..... 241/171
4,976,472 A * 12/1990 Kozlov et al. ..... 241/172
4,987,702 A 1/1991 Anschutz
4,998,467 A 3/1991 Kovach
5,046,287 A * 9/1991 Lin ..... 451/326
5,286,532 A 2/1994 Yoshikawa et al.
5,456,954 A 10/1995 Sullivan
6,123,534 A * 9/2000 Kasashima et al. ..... 604/96.01

* cited by examiner

*Primary Examiner*—Joseph J. Hail, III
*Assistant Examiner*—Anthony Ojini
(74) *Attorney, Agent, or Firm*—J. Bennett Mullinax LLC

(57) ABSTRACT

An apparatus and process of surface finishing golf balls prior to painting is provided. The apparatus and process make use of nylon loops as a finishing material that is used to abrade the surface of adjacent moving golf balls. Optionally, the abrading process between the nylon loops and the surface of the golf balls may be carried out in the presence of a continuous stream of water. As water is removed from the processing equipment, the removed water carries with it abraded material. The process provides for improved adhesion of the paint to the surface of the golf ball.

12 Claims, 7 Drawing Sheets

BALL FINISHING PROCESS

FIELD OF THE INVENTION

This invention is directed towards an apparatus and process for preparing a molded article, such as a golf ball, for surface painting.

BACKGROUND OF THE INVENTION

This invention relates to a treatment process, an apparatus, and a finishing surface that is useful in the bulk treatment of golf balls and similar articles.

During the manufacturing process of a golf ball, it becomes necessary to prepare the golf ball surface for painting. Typically, following the injection molding of the golf ball, there is a buffing or grinding step that removes the mold lines from the surface of the golf ball. Thereafter, a batch sandblasting (wet blast) step may be performed using a fluidized grit solution which is impacted against the exterior of the golf balls. Subsequent to the optional sandblasting step, a vibratory process is carried out in which a frit material and abrading agents are used to further de-burr the cover and provide a smooth, paintable surface to the golf ball cover. Accordingly, the sequential steps outlined above involves the use of abrasive media including crushed glass particles, glass beads, sand, shot, aluminum oxide, and other similar abrasive materials.

Heretofore, problems have existed in obtaining a uniform surface of the golf balls using the above described techniques. In particular, it has been difficult to achieve a uniform and smooth surface finishing step on a dimpled spherical object such as a molded golf ball. Typical finishing apparatuses and techniques described above bring about a coarse surface finish to the golf ball. As a result of the coarse finish, the subsequent paint quality is less glossy than would be attainable from a smoother finish. Further, the abrasive media requires periodic replenishment as the abrasive material rapidly loses its effectiveness. Additionally, the use of the abrasive materials requires large volumes of water and results in the generation of large amounts of waste abrasive material and wastewater. Further, the abrasives degrade the processing equipment at contact points between the abrasive materials and the finishing equipment.

Other ball finishing techniques known in the art include plasma surface treating such as disclosed in U.S. Pat. No. 5,286,532 and which is incorporated herein by reference. It is also known in the art to treat a surface of a golf ball with UV light to improve the adhesive bonding of a topcoat. This methodology is disclosed in U.S. Pat. No. 5,456,954 and which is incorporated herein by reference.

However, there remains room for improvement and variation within the art.

SUMMARY OF THE INVENTION

It is one aspect of at least one of the present embodiments to provide a process and a useful apparatus for bringing about improved surface finishing of a spherical article such as a molded golf ball.

It is another aspect of at least one of the present embodiments to provide a contact surface for a ball finishing apparatus in which the surface comprises a contact layer of nylon loops which are used to treat a surface of passing articles such as a golf ball. In one aspect of one of the present embodiments it has been found that use of a nylon loop, such as the loop portion of a hook and loop Velcro® brand fastener, provides an effective surface finishing substrate which is effective for both the dimpled and the non-dimpled regions of the golf ball.

It is yet another aspect of at least one of the present embodiments to provide an apparatus in which a rotary impeller is used to engage a plurality of golf balls within the confines of a finishing tumbler. The walls, floors, and/or exposed surfaces within a tumbler may contain nylon loop material that is used to engage the exterior surfaces of the golf balls. Further, combining the tumbling step in conjunction with a water bath has been found to effectively clean the golf ball surfaces. The water removes abraded material along with the wash water as part of the continuous washing process. Accordingly, the process is self-cleaning and does not involve the use of hazardous solvents or the generation of any undesired waste products.

It is yet another aspect of at least one of the present embodiments to provide an improved apparatus and process which prepares a surface of a molded spherical object such as a golf ball for a subsequent painting step.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

Figure 1:
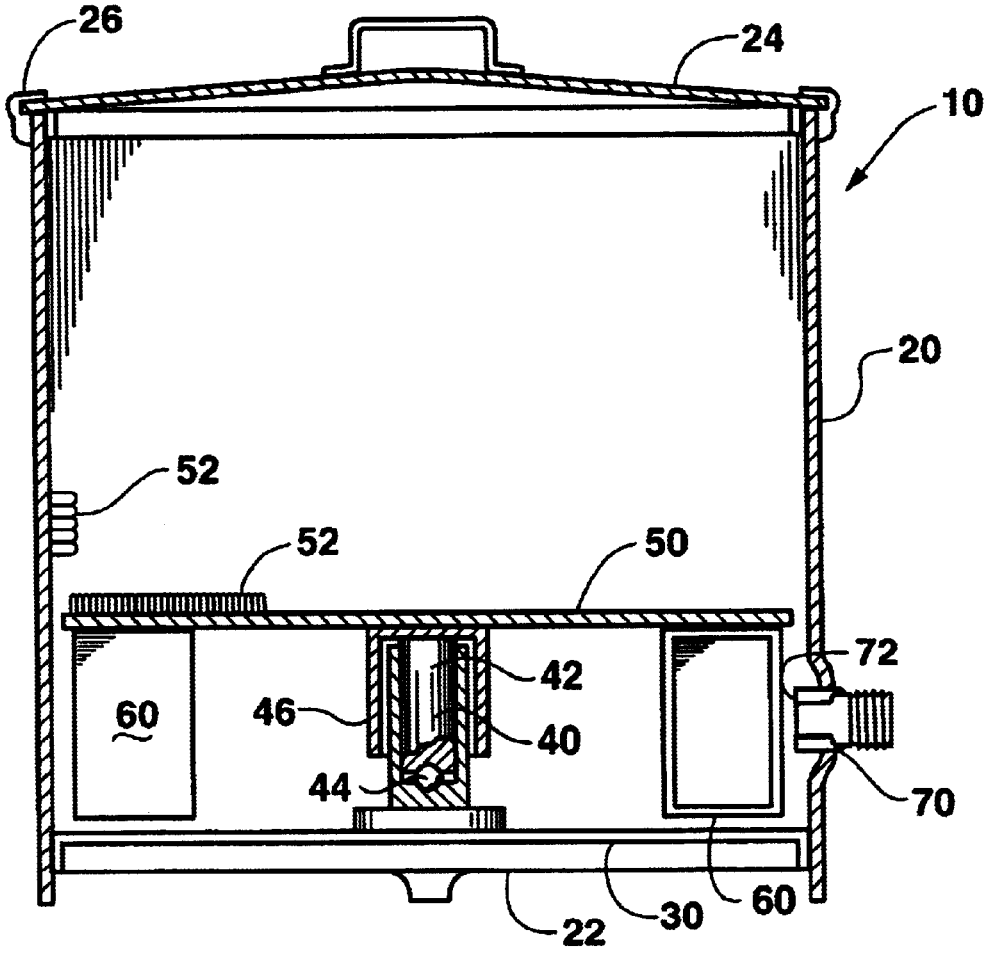
FIG. 1 is a cross sectional view of a finishing apparatus constructed in accordance with this invention.

Set forth in FIG. 1 is a ball finishing apparatus 10 having a cylindrical receptacle 20 having an open bottom 22 and a removable cover 24. The cover 24 may be secured to the receptacle 20 through any number of conventional securement means such as clamps 26. A support member 30 extends across the bottom of the receptacle and is adapted for supporting therefrom a central socket member 40. Rotatably mounted within the socket 40 is a vertical post 42 that supports a horizontal plate 50. An upper surface of the plate may provide a support surface for mounting a finishing substrate such as filamentous loop members 52. The loop members 52 found useful in the present invention include loop members having a length of about 100 to 110 mm and a loop width of about 16 to 50 mm. However, a variety of different size loop fabrics are available and the length and width of the loops are not believed critical to the practicing of this invention. One supplier of a variety of different sized nylon hook and loop material is Velcro Industries (Netherlands), manufacturer of Velcro® brand hook and loop fasteners. However, filamentous loop material provided from other materials are also believed useful in practicing the present invention.

A ball bearing 44 may be provided at the bottom of the socket 40 and thereby support and engage the vertical post member 42. An inverted cap 46 encloses an upper end of the socket 40. The plate 50 and the inverted cap 46 may be fixed to the post 42 in any suitably operative manner, so as to facilitate rotation of the plate 50 relative to socket 40.

The bottom of the plate 50 has supported thereon a plurality of impeller blades 60. The side of the receptacle 20 defines a conduit 70 for attachment to a conventional water hose or pipe. The conduit 70 has a first end 72 extending into the interior of the cylindrical receptacle, the conduit first end 72 being adjacent the impeller blades 60 and below the plane of the rotatable plate. The conduit terminus is designed to discharge water against the impeller blades while additionally directing, through orifice 74, a portion of the water upwardly into the open area of the receptacle. The force of the discharge water against the impeller blades causes the rotation of plate 50 and post 42 relative to socket member 40.

Figure 2:
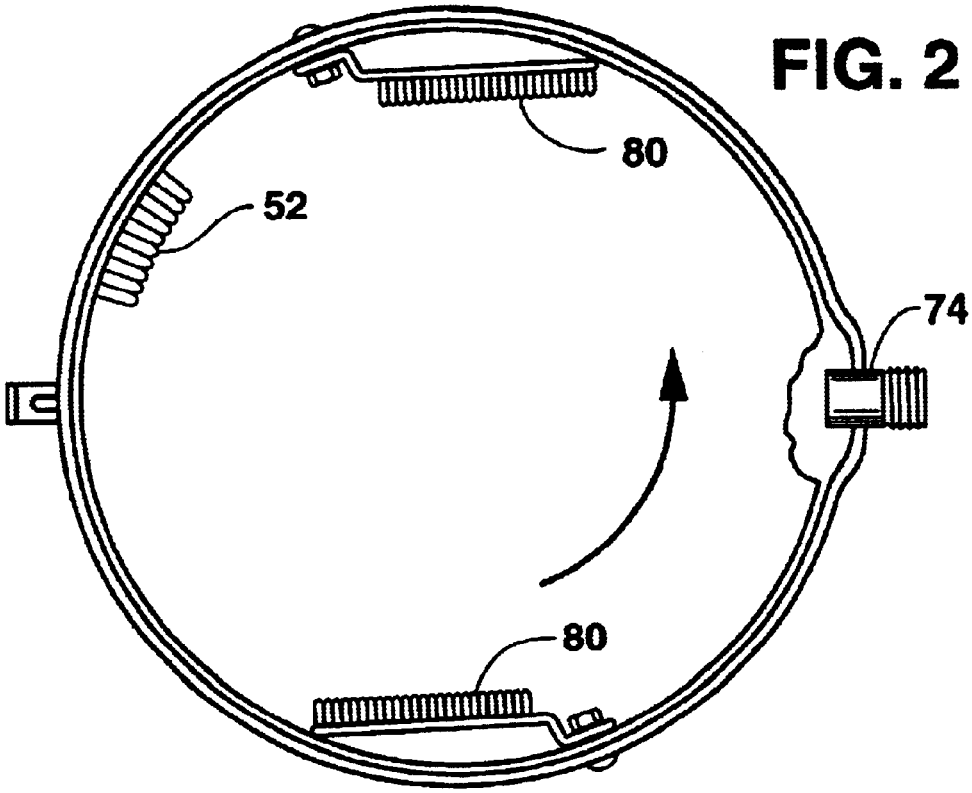
FIG. 2 is a plan view of FIG. 1 in which the cover has been removed and certain internal parts have been broken away to better illustrate the apparatus.
Figure 3:
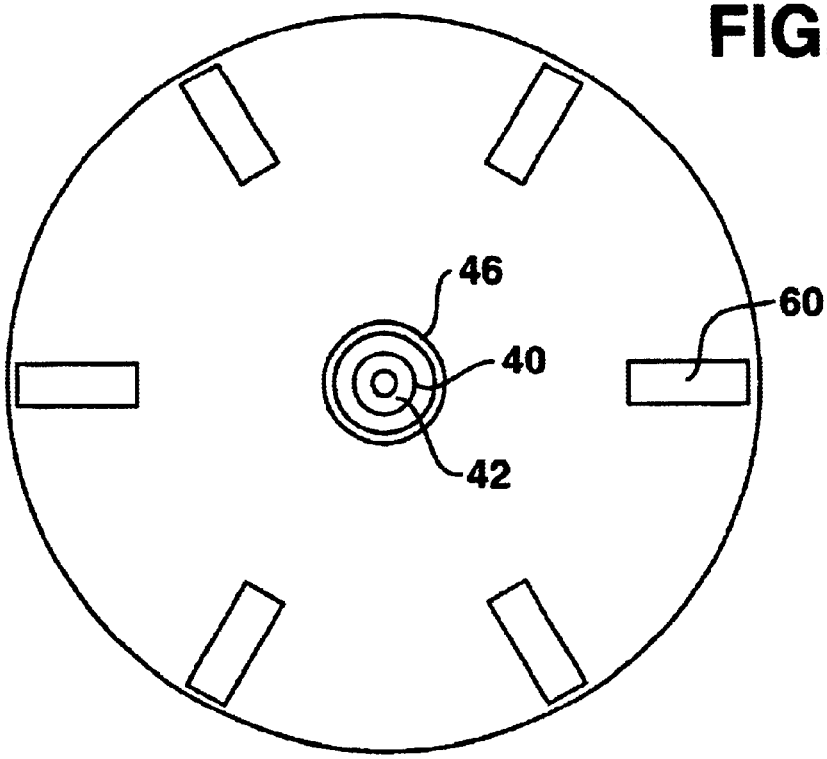
FIG. 3 is a bottom plan view of a rotary plate as seen in FIGS. 1 and 2.

As best seen in reference to FIGS. 1 and 2, the interior walls of the receptacle 20 may also contain portions of the loop fabric 52 and thereby increase the contact surface area of loop material within the receptacle. The loop fabric 52 may be secured to the interior walls of the receptacle by a corresponding layer of hook material affixed to the interior wall. This arrangement allows the loop material to be easily applied to the adjacent hook portion affixed directly to the interior wall. In turn, this makes replacement of the loop fabric 52 a simple matter of peeling away the used loop fabric 52 for replacement with a fresh loop surface.

In operation, the apparatus 10 is filled with a plurality of unfinished golf balls 90. After securing the lid to the receptacle, water is introduced through the conduit 70 causing the water to strike the sides of the impeller blades 60, thereby causing a counter-clockwise rotation of the plate 50. The golf balls supported by plate 50 will be carried forward, but due to their weight and space restrictors 80 positioned on the sides of the receptacle, the balls will move slower than the finishing plate. As a result, the surfaces of the balls will be repeatedly engaged by the loop material as the balls tumble. The vertical movement of water from the orifice 74 will clean the golf balls and allow removed material to pass from the apparatus through the bottom of the receptacle.

Figure 5:
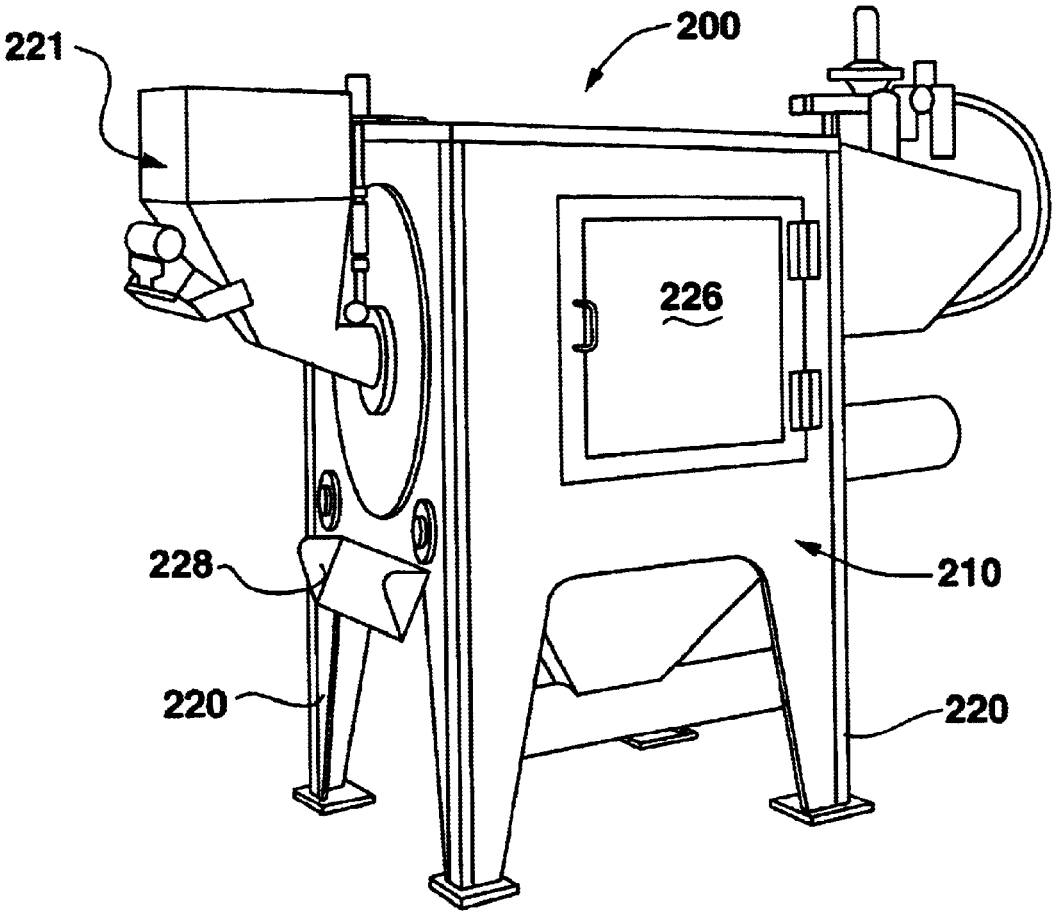
FIGS. 5 and 6 are directed to an alternative embodiment of a finishing apparatus setting forth a helical rib fixed to an inner portion of the drum and which is adapted to direct articles within the drum along an outer wall of the drum.
Figure 6:
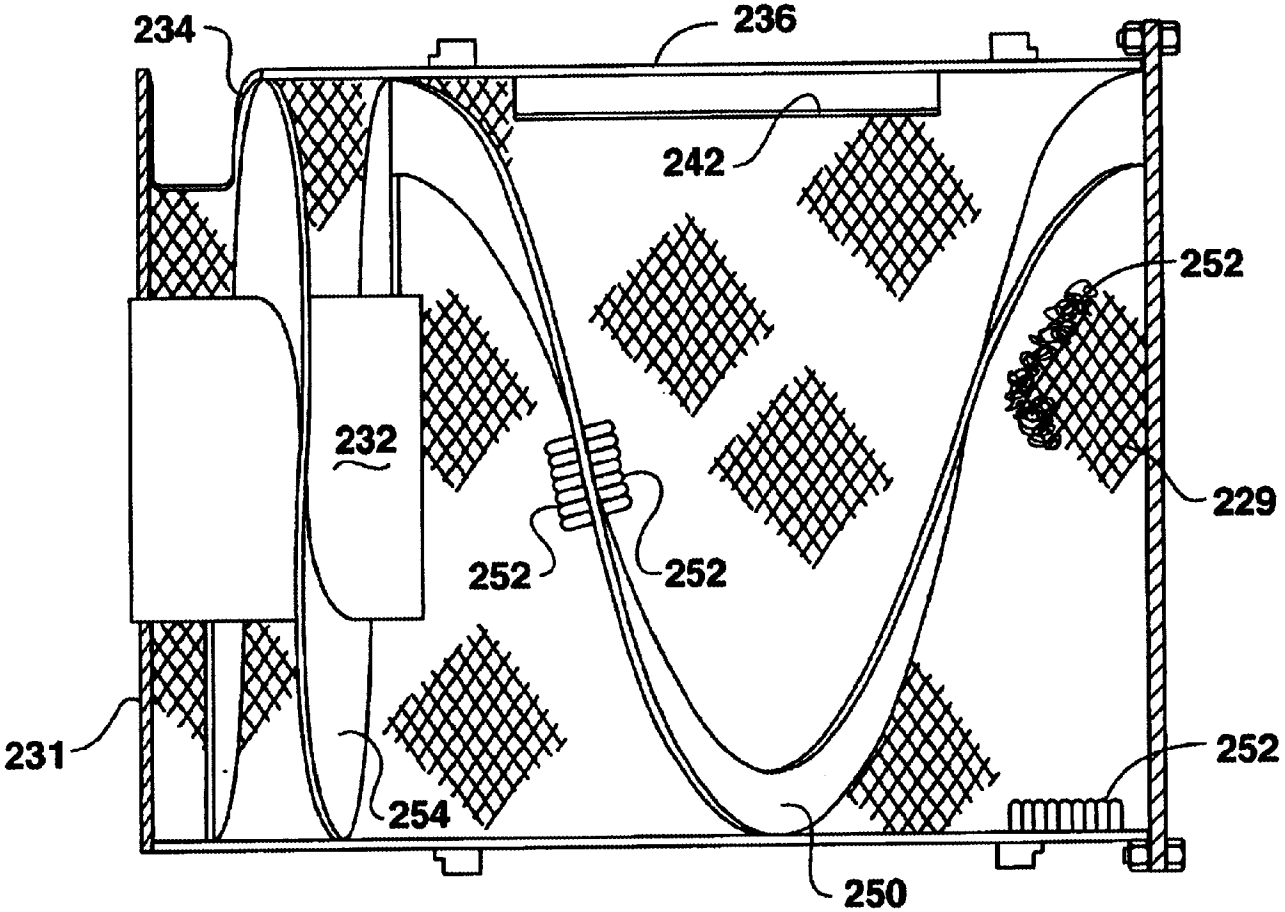

In accordance with the invention, a second embodiment is seen in reference to FIGS. 5 and 6. The finishing machine 200 of the second embodiment has an outer frame 210 supported by a plurality of legs 212. The finishing machine has a feed hopper 221, a door 226, and a discharge chute 228. The interior of the container defines a cylindrical drum 229 constructed of a rigid mesh. A front wall 231 of the drum defines an inlet cone 232 along with an opening 234 in the drum wall. Adjacent a re-closable door 236, an additional opening 242 is also provided in the mesh drum. Additional details of the construction and operation of machine 200 with respect to a plurality of golf balls is best seen and described in reference to U.S. Pat. No. 3,603,036 which is incorporated herein by reference.

As best seen in reference to FIG. 6 and in accordance with the present invention, a helical blade 150 is fixed with the cylindrical mesh drum and used to direct golf balls within the interior of the drum. The interior surfaces of the drum may be equipped with nylon loop material 252 along with the blade surfaces. By the rotation of the drum and the blade, the golf balls are directed against the loop portion of the finishing substrate. If desired, the tumbling action of the balls relative to the drum and nylon loops may be carried out in the presence of water or other liquid, but does not require the introduction of abrasive grit or similar materials to achieve a finished surface to the golf ball. When present, it is useful if the water is introduced and removed in a continuous fashion, thereby providing a fresh supply of clean water with the removed portion of the water containing abraded material from the surface of the golf balls.

Figure 7:
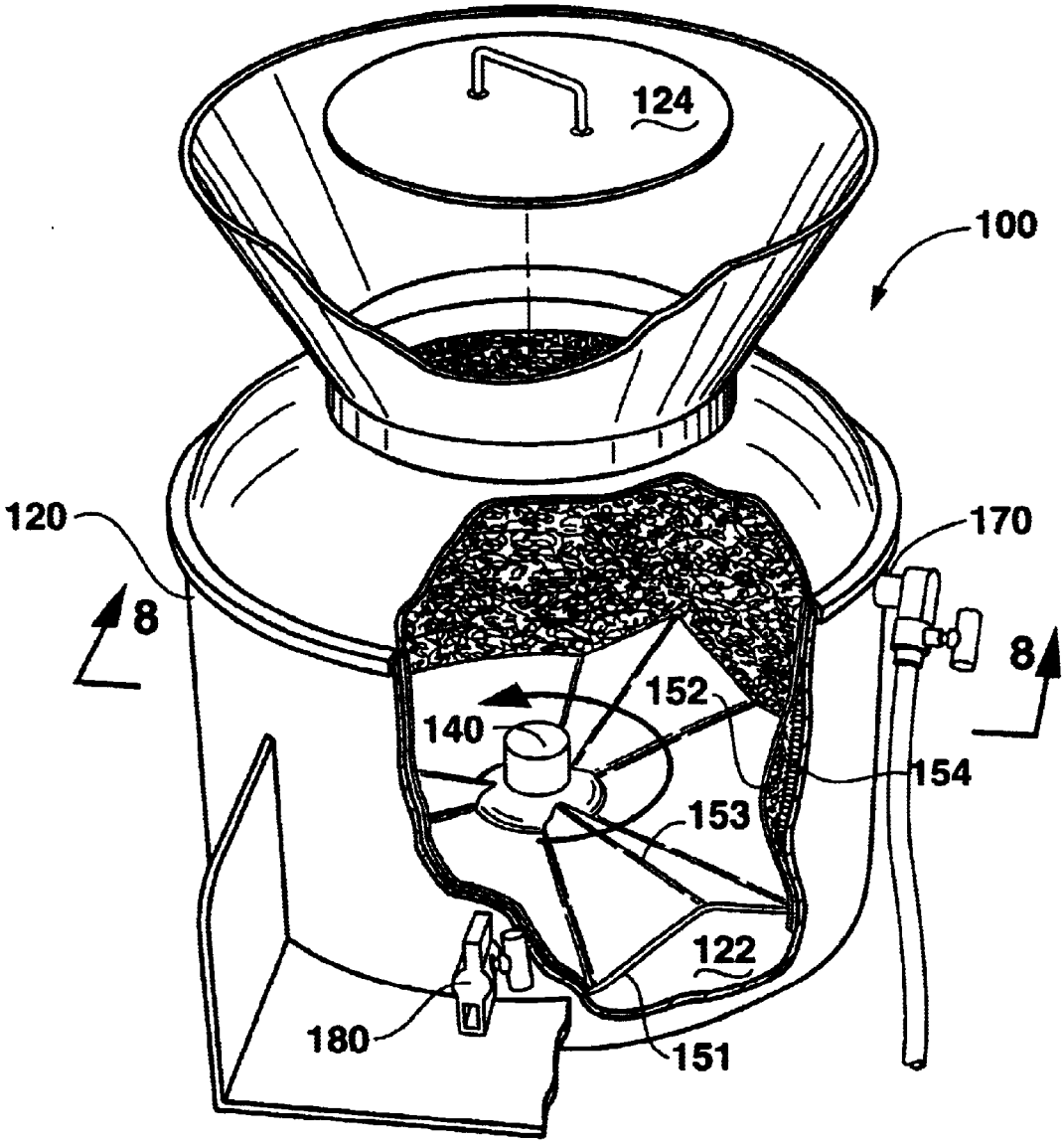
FIG. 7 is a perspective view of an additional embodiment of a finishing apparatus in which certain internal parts which have been broken away to better illustrate the apparatus.
Figure 8:
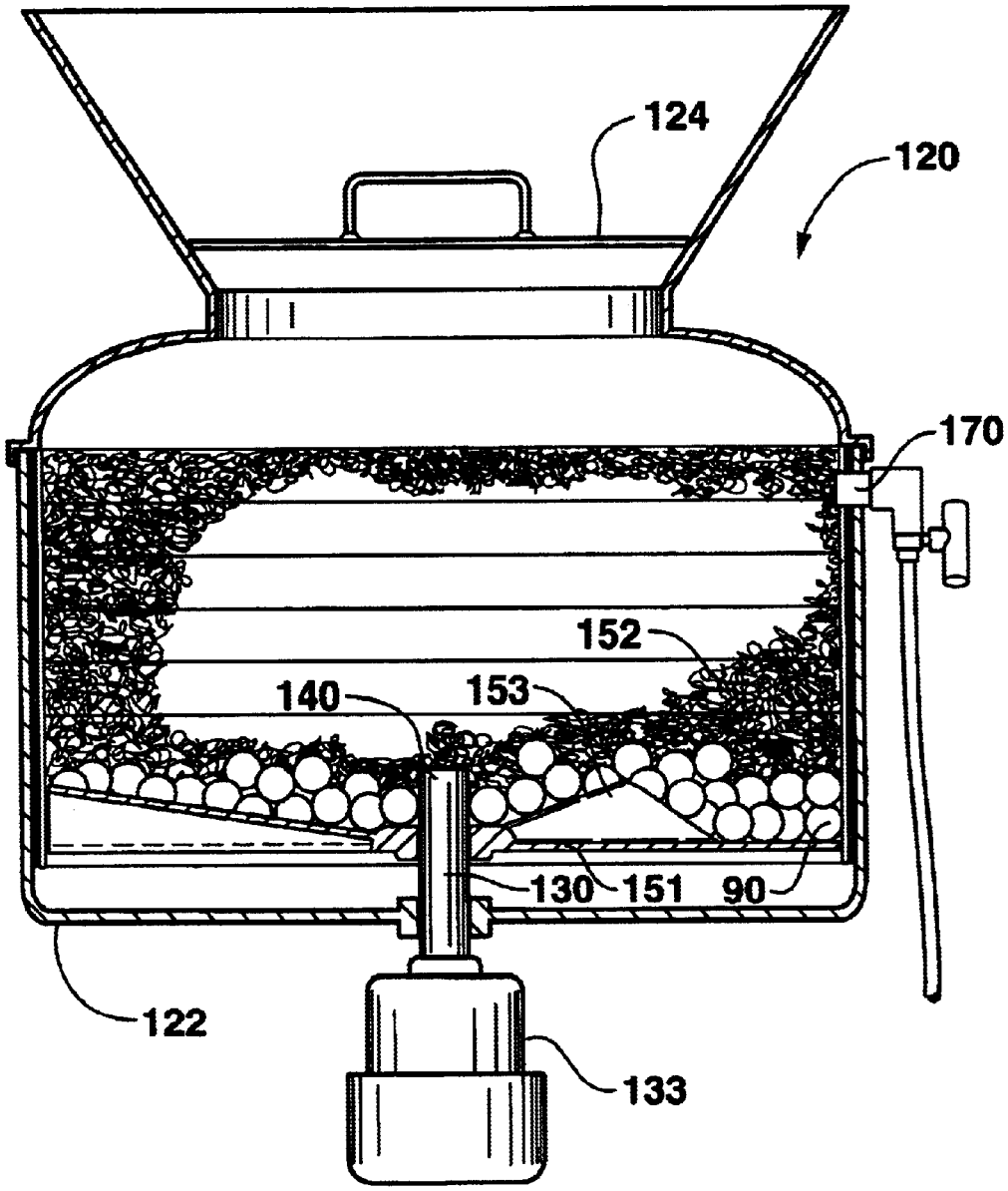
FIG. 8 is a sectional view taken along line 8—8 of FIG. 7 setting forth additional aspects of the embodiment.

A third embodiment of the invention may be seen in reference to FIGS. 7 and 8. In this embodiment a ball finishing apparatus 100 is provided in the form of a cylindrical receptacle 120 having a bottom 122 and a removable cover 124. The cover 124 may be further secured to receptacle 120 through any conventional means of securement such as a threaded engagement, a latch, or a hold-down apparatus. The receptacle bottom 122 is in communication with a rotor 130. Rotor 130 is in further communication with a drive element 133. Drive element 133 may be actuated by a drive belt (not illustrated) engaging a base of the spindle. Alternatively, the drive element 133 may be in the form of a direct drive motor such as an electric motor. Rotor 130 may be used to engage a inverted cup 140 defined by a plate member 151, plate member 151 adapted for placing within the interior of receptacle 120 and elevated slightly above bottom 122 of the receptacle. Alternatively, rotor 130 may engage the adjacent edge walls of plate member 151 so as to rotate the plate member 151 in response to the rotation of rotor 130.

Figure 4:
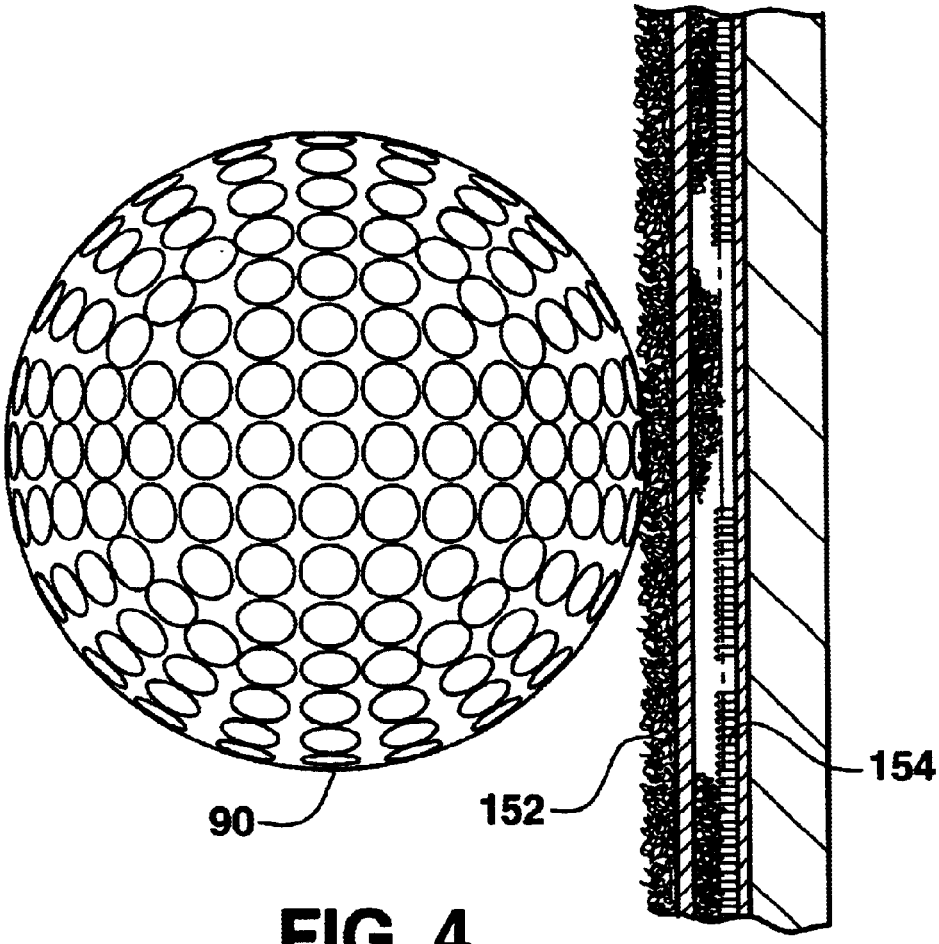
FIG. 4 illustrates in cross section an enlarged detail of the loop finishing material in association with a surface of a golf ball.
Figure 9:
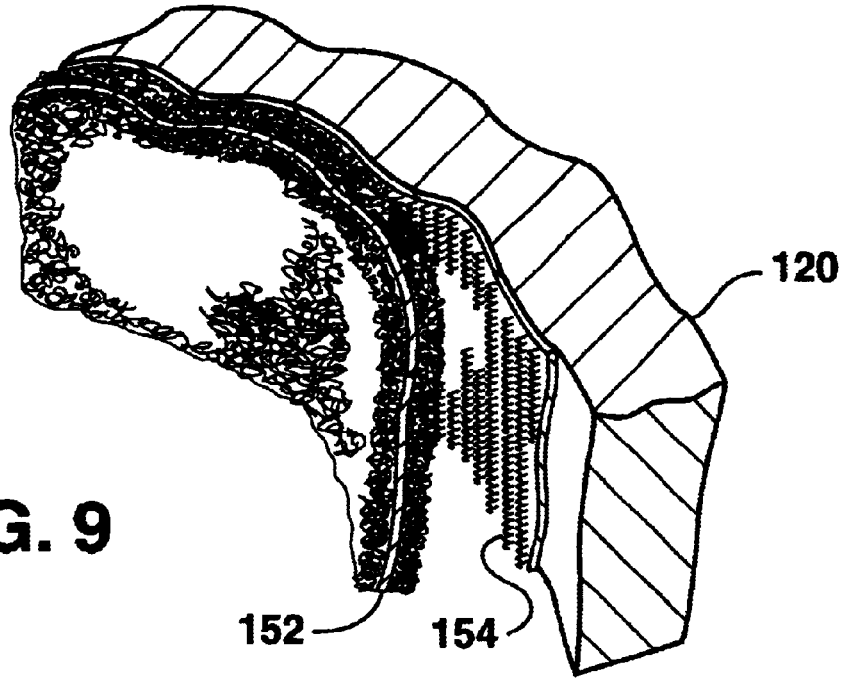
FIG. 9 is an enlargement of an edgewall of a receptacle showing the attachment of the loop portion of a finishing fabric to the corresponding hook portion, the hook portion affixed to the interior wall of the receptacle.

As best seen in reference to FIGS. 7 and 8, an upper surface of plate member 150 defines a plurality of inclined surfaces 153. The interaction of the motor rotor and the inverted cup 140 is used to rotate the plate member 151. As illustrated, the inclined surfaces 153 of the horizontal plate member 151 taper in thickness towards the center of the horizontal plate member 151. The rotation of the plate member 151 causes the inclined surfaces 153 to direct a quantity of associated golf balls 160 against the sides of the container. Portions of the interior sidewalls of the receptacle 120 engage a loop fabric 152. Preferably, loop fabric 152 is attached to the receptacle interior wall through a corresponding hook portion 154 of a hook and loop fabric as seen in FIGS. 4 and 9. In this manner, the loop portion may be readily attached and removed as needed. Further, when one surface of the loop fabric 152 has been worn down, the fabric may be simply removed and turned over to provide a fresh surface of the loop fabric.

The receptacle 120 is also in communication with a water inlet 170 along an upper wall of the receptacle 120. A drain 180 is defined along a lower wall in proximity to the bottom 122. In operation, the apparatus 100 is filled with a plurality of unfinished golf balls 90. After securing the lid to the receptacle, a continuous supply of water is introduced into the receptacle. Through the operation of the rotor 130, the spindle 140 and plate member 151 are rotated, thereby directing the golf balls against the sidewall of the receptacle. As a result, the surfaces of the balls repeatedly engage the loop material as the balls are moved within the receptacle. The continuous supply and movement of water through the apparatus cleans the golf balls and allows removed, abraded material to pass from the apparatus through the drain 180 defined in proximity to the bottom of the receptacle.

EXAMPLE 1

The ability of the nylon loops to provide a suitable ball finish was evaluated in terms of the paint adhesion properties of the resulting painted balls. A ball finishing apparatus as seen and described in reference to the embodiment of FIGS. 7 and 8 was used to surface finish a series of molded golf balls. Between 300 and 350 golf balls 90 are introduced into the receptacle 120. Balls 90 have been previously ground to remove molded lines. The drive element 133 is used to engage the rotor 130 at a rotational speed of between 100 to 400 RPM. The balls are processed in the ball finishing apparatus 100 for approximately 10 minutes. During the processing time, a continuous stream of water is provided as described in reference to the figures. Following the finishing step, the balls were dried and painted in a conventional manner.

For the purposes of comparison, a standard wet blast/vibratory finishing process was used to treat a series of control balls. Following treatment, the control balls were also painted using conventional techniques.

Paint Adhesion

The adhesion of paint to the surface of trial and control balls was evaluated by hitting painted trial and control balls using an iron face club ball tester. Each ball was hit 30 times with an iron having a club head speed of about 110 mph and then evaluated for integrity of the painted surface.

Cross-Cut Test

The balls were further evaluated by scoring the ball surface with a series of horizontal and vertical cuts. A total of 10 vertical and 10 horizontal cuts were made into the surface of each ball. Thereafter, an adhesive, transparent tape was firmly applied against the surface of the ball along the aforementioned cuts. The tape was then peeled away and the tape surface evaluated for paint adhesion.

Water Test

The painted golf balls were submerged in water for 72 hours at 23° C. Following the water test, the cross-cut test as described above was performed.

Results

In all instances, the paint adhesion, cross-cut test, and water test indicate that golf balls which are surface finished with the nylon loop material prior to painting demonstrate improved paint adhesion properties compared to painted golf balls having a surface prepared using a convention of wet blast/vibratory process. It is further noted that following the treatment of a total of 360,000 golf balls, the loop surfaces still provided a ball finish surface which adhered paint at least as well as a standard wet blast/vibratory process.

If desired, the finishing apparatuses as set forth above may be used in combination with additional, more conventional abrasive materials in order to achieve a desired surface finish. However, it has been found that the use of the nylon loop material as an abrasive offers an improved surface finish to a molded golf ball as opposed to the use of only conventional techniques of sandblasting and vibratory practices.

In accordance with the present invention, it has been found that using the nylon loop material as an abrasive surface offers advantages over conventional finishing techniques. The resulting finish to the golf ball provides a surface which offers better paint adhesion as opposed to a conventional golf ball having a surface treated with an abrasive grit. Additionally, the cost of the grit and disposal cost of the spent grit are avoided when the nylon loop material is employed as the ball finishing substrate. Also, the life span of ball finishing equipment is believed to be greatly extended when using the nylon loop material as opposed to an abrasive grit. The abrasive grit generates rapid wear of a ball finishing apparatus which comes in contact with the grit. As such, the use of the nylon loop material for finishing golf balls offers advantages in terms of quality, finishing substrate cost, and lower maintenance costs of the finishing equipment.

In accordance with the present invention, the nylon loop material has been found to provide a uniform contact substrate to the surfaces of the golf ball and imparts an improved texturing and surface preparation of the golf ball surface. The use of the closed loop material avoids excessive wear that may occur with pointed bristles. The rounded loop end provides a broad contact region between the loop and the surfaces of the golf ball.

In accordance with the invention, it has been found that a finishing apparatus as described above, can process a quantity of between 300 and 350 golf balls in a 10 minute interval. Upon removal from the finishing apparatus, the balls merely require a drying step prior to painting. During evaluation of the nylon loop finishing material, it has been found that the length and width of the loop material is not critical with respect to surface finishing of golf balls. The dimensions reported above have been found useful, but Applicant believes other lengths and widths of loop material may offer comparable results.

The present invention is not limited to merely the exemplary embodiments described herein. Rather, any conventional finishing machine, commonly referred to in the art as "potato peelers" or "tumblers", may be used to advantage by equipping a portion of the interior surfaces with the nylon loop material so as to bring about contact with the golf balls upon operation of the finishing machine. For instance, U.S. Pat. No. 3,603,036 assigned to W. L. Reed Company and which is incorporated herein by reference, provides an abrading machine using an open mesh drum in which a reciprocating motion is used to abrade golf balls that are in contact with an abrasive medium. Such an apparatus, as taught herein, provides an interior surface of loop material in accordance with the present invention.

Referring now to the drawings, and to FIGS. 5 and 6 in particular, there is shown one such abrading machine having an outer casing 210 supported by a plurality of legs 220. The abrading machine has a feed hopper 221, a door 226, and a discharge chute 228.

Articles such as golf balls pass from the feed hopper 221 into a cylindrical drum 229 seen here in the form of a rigid expanded metal or other such mesh. Drum 229 defines a front wall 231 having an inlet cone 232 welded thereto, an opening 242 in the drum wall and a door 236 secured in the opening 242. An opening 234 is also provided in the mesh drum 229 adjacent the front wall 231. The drum is supported and driven rotatably as best seen and described in reference to U.S. Pat. No. 3,603,036 and which is incorporated herein by reference.

A helical conveyor blade 250 is fixed within the cylindrical mesh drum 229 for conveying the articles into an abrading area of the drum 229. A discharge helical blade 254 has a smaller pitch than the blade 250 and is mounted to drum 229 and to inlet cone 232 between the ends of the inlet cone 232. In other words, the discharge helical blade 250 extends radially between the wall of mesh drum 229 and the outer wall of discharge cone 232.

As best seen in reference to FIG. 6, blade 250 and at least portions of the interior or the drum 229 may be covered with nylon loop material 252. In operation, golf balls positioned within the interior of the rotating drum 229 will come in contact with the fixed blade 250, blade 250 further directing the balls against the drum walls covered with nylon loop material 252. In this manner, the nylon loop material 252 will engage the surface of the golf balls as described above, preparing the ball surface for subsequent processing. The attachment of the nylon loop material 252 may be similar to that described earlier in reference to additional embodiments of the invention. In other words, nylon hook material may be used to reversibly engage the nylon loop material 252 to the desired areas and regions of drum 229 and blade 250.

The mesh construction of drum 229 facilitates the entry and passage of water through the drum using the various sprayheads and nozzles referenced in U.S. Pat. No. 3,603,036 which is incorporated herein by reference. Once an adequate amount of processing time has occurred, the drum 299 is rotated in a reverse direction. The golf balls will then be conveyed by helical blade 250 toward the front end of the machine where the balls are directed towards a discharge chute 228.

It is also envisioned that other surfaces may be used to provide the loop contacting material. For instance, in addition to or in replacement of the loop covered surfaces affixed within the ball finishing apparatus, it is possible to provide a plurality of spherical abraders, each abrader having at least a portion of an exterior surface carrying a strip of loop material. Such abraders may have a size similar to a golf ball and, when introduced into the interior of the finishing apparatus, the abraders are moved and agitated along with the balls.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A process for surface finishing a plurality of articles having irregular surfaces comprising:

supplying a container adapted for housing said plurality of articles, said container having a portion of its interior surface defining a plurality of filamentous loops;

introducing said supply of articles having irregular surfaces;

moving said articles relative to said container, thereby contacting said irregular surfaces of said articles against said loops; and, continuing said movement of said articles relative to said loops until a desired surface finishing of said articles has occurred.

2. The process according to claim 1 wherein said supply of articles further defines a plurality of golf balls.

3. A golf ball made according to the process of claim 2.

4. The process according to claim 1 wherein said step of moving said articles relative to said container further includes introducing a supply of water to said container.

5. The process according to claim 1 wherein said plurality of filamentous loops further comprises the loop portion of a hook and loop fabric fastener.

6. A process of surface finishing a plurality of spherical articles comprising:

supplying a container adapted for housing said plurality of spherical articles;

introducing a supply of said spherical articles into the container;

providing within the container an abrasive surface comprising a plurality of filamentous loops;

moving the spherical articles within the container, thereby contacting a surface of the spherical articles against the loops; and, continuing the movement of the spherical articles relative to the loops until a desired surface finishing of the articles has occurred.

7. The process according to claim 6 wherein said step of moving the spherical articles within the container further includes introducing a supply of water to said container.

8. A golf ball made according to the process of claim 7.

9. The process according to claim 6 wherein said plurality of filamentous loops further comprises the loop portion of a hook and loop fabric fastener.

10. The process for surface finishing a plurality of articles having irregular surfaces comprising:

supplying a container adapted for housing said plurality of articles, said container having a portion of its interior surface defining a loop portion of a hook and loop fabric fastener;

introducing said supply of articles having irregular surfaces;

moving said articles relative to said container, thereby contacting said irregular surface of said articles against said loop portion; and, continuing said movement of said articles relative to said loop portion until a desired surface finishing of said articles has occurred.

11. The process according to claim 10 wherein said supply of articles further defines a plurality of golf balls.

12. The process according to claim 10 wherein said step of moving said articles relative to said container further includes introducing a supply of water to said container.

* * * * *